US007310833B2

(12) United States Patent
Maguire et al.

(10) Patent No.: US 7,310,833 B2
(45) Date of Patent: Dec. 25, 2007

(54) SWIMMING POOL LIFT AND TRANSFER BAR

(75) Inventors: John P. Maguire, Wilsonville, OR (US); Joey Bill G. Weimer, Missoula, MT (US); George E. Bowman, Missoula, MT (US); Scott Thomas Cardinal, Missoula, MT (US); Lee A. Sutherland, Turah, MT (US)

(73) Assignee: Spectrum Products, LLC, Missoula, MT (US)

( * ) Notice: Subject to any disclaimer, the term of this patent is extended or adjusted under 35 U.S.C. 154(b) by 0 days.

(21) Appl. No.: 11/172,131

(22) Filed: Jun. 29, 2005

(65) Prior Publication Data

US 2006/0048294 A1 Mar. 9, 2006

Related U.S. Application Data

(60) Provisional application No. 60/584,737, filed on Jun. 30, 2004.

(51) Int. Cl.
*E04H 4/00* (2006.01)

(52) U.S. Cl. ..... 4/496

(58) Field of Classification Search ..... 4/494, 4/496; 5/86.1, 87.1
See application file for complete search history.

(56) References Cited

U.S. PATENT DOCUMENTS

| | | | | |
|---|---|---|---|---|
| 3,077,613 | A * | 2/1963 | Mayer | 482/139 |
| 3,203,009 | A | 8/1965 | Lundberg | 5/81 |
| 3,608,104 | A | 9/1971 | Van Gerven | 5/83 |
| 3,694,829 | A | 10/1972 | Bakker | 5/81 |
| 3,712,671 | A * | 1/1973 | Dalton et al. | 297/258.1 |
| 3,955,797 | A | 5/1976 | Richards | 254/89 H |
| 3,981,484 | A | 9/1976 | James | 254/148 |
| 4,053,412 | A | 10/1977 | Stix | 210/169 |
| 4,141,089 | A | 2/1979 | Krumbeck | 4/172 |
| 4,183,106 | A | 1/1980 | Grimes et al. | 4/172 |
| 4,283,803 | A | 8/1981 | Krumbeck | 4/496 |
| 4,454,691 | A * | 6/1984 | Mitchell | 52/202 |
| 4,941,216 | A | 7/1990 | Boublil | 4/496 |
| 4,996,728 | A * | 3/1991 | Nolan | 4/496 |
| 5,218,727 | A | 6/1993 | Krumbeck | 4/583.1 |
| 5,465,433 | A | 11/1995 | Nolan | 4/496 |
| 5,560,053 | A | 10/1996 | Mills | 5/81.1 R |
| 5,572,921 | A | 11/1996 | Krumbeck | 92/165 R |
| 5,678,253 | A | 10/1997 | Baker | 4/495 |
| 5,709,154 | A | 1/1998 | Schott | 105/29.1 |
| 5,790,995 | A * | 8/1998 | Caden et al. | 5/86.1 |
| 6,170,612 | B1 | 1/2001 | Krumbeck | 187/200 |
| 6,378,659 | B1 | 4/2002 | Krumbeck | 187/200 |
| 6,934,980 | B2 * | 8/2005 | Harney | 5/81.1 R |
| 2003/0178252 | A1 | 9/2003 | Schmidt | |
| 2005/0086730 | A1 | 4/2005 | Terzo | |

* cited by examiner

*Primary Examiner*—Charles E. Phillips
(74) *Attorney, Agent, or Firm*—Shane P. Coleman; Holland & Hart LLP

(57) ABSTRACT

A lift is provided to facilitate access to swimming pools and spas. The lift includes a base and a mast extending therefrom. An arm pivotally connects to the mast. A seat assembly connects to the arm. An overhead support is positioned above the seat assembly. A first actuator moves the arm about the mast, thereby moving the seat assembly between raised and lowered positions, to bring the seat assembly out of and into a pool. A second actuator rotates the seat assembly relative to the base to position the seat assembly over the pool or deck. In use, the lift attaches to a pool deck, adjacent the pool, and a user accesses the seat assembly from the deck. The second actuator rotates about the base to position the user over the water. The first actuator lowers the seat assembly, and the user exits the seat assembly into the water.

48 Claims, 10 Drawing Sheets

SWIMMING POOL LIFT AND TRANSFER BAR

RELATED APPLICATIONS

The present invention claims the benefit of the filing date of U.S. Provisional Patent Application No. 60/584,737, filed Jun. 30, 2004, entitled "Swimming Pool Lift and Transfer Bar," which is hereby incorporated by this reference as though set forth fully herein.

FIELD OF THE INVENTION

The present invention relates generally to swimming pool accessories. More particularly, it relates to a lift for use by a person to access a swimming pool from a pool deck.

BACKGROUND OF THE INVENTION

In the field of swimming pool accessories, various types of stationary and portable chairs and lifts are used to provide access to the pool. In particular, such chairs may be used by disabled or elderly people for whom pool access is difficult. Such individuals may access the pool alone or with the assistance of one or more other individuals who are located either in the pool or on the pool deck, or both. Conventional pool lifts have various shortcomings, namely that they are difficult for an individual to access and are difficult to control by both the user and any assistants.

SUMMARY OF THE INVENTION

In one exemplary embodiment of the present invention, a lift is provided. The lift includes a base and a mast extending from the base. An arm is pivotally connected to the mast. A seat assembly is connected to the arm. An overhead support positioned above the seat assembly. First and second actuators control movement of the lift. The first actuator moves the arm about the pivotal connection between the arm and the mast, thereby moving the seat assembly between a raised position and a lowered position. A second actuator rotates the seat assembly relative to the base.

In another exemplary embodiment of the present invention, a lift is provided. The lift includes a seat support having first and second ends. A seat is attached to the seat support proximate the first end. An overhead support attached to the seat support proximate the second end. An actuator moves the seat relative to a pool deck on which the lift is positioned.

In still another exemplary embodiment, an overhead support assembly for attachment to a swimming pool lift is provided. The assembly includes a rigid, elongated member having first and second ends. The first end detachably connects to an upper portion of a seat support of a swimming pool lift. The assembly further includes an overhead bar and means for connecting the overhead bar to the elongated member to allow the overhead bar to be positioned above a seat of the lift, within reach of a user positioned in the seat. As the lift moves between raised and lowered positions, the overhead bar remains in substantially equal distance from the seat in both the raised and lowered positions.

In still another exemplary embodiment of the present invention, a transfer system for a swimming pool lift is provided. The transfer system includes a base cart assembly and a seat cart assembly. The base cart assembly includes an axel that defines a stem-receiving portion. A first pair of wheels is connected to opposing ends of the axel. A handle extends from the axel. First and second spaced-apart rigid members connect to the axel and extend outward from the axel. Each of said members defines a recessed portion adapted, respectively, to engage pins on opposing sides of a stem. The seat cart assembly includes a second pair of wheels connected by a raised intermediate member and means for supporting a seat of a lift, said means being connected to the second pair of wheels.

The foregoing and other features, utilities and advantages of the invention will be apparent from the following more particular description of a preferred embodiment of the invention as illustrated in the accompanying drawings.

BRIEF DESCRIPTION OF THE DRAWINGS

The detailed description will refer to the following drawings, wherein like numerals refer to like elements, and wherein.

DETAILED DESCRIPTION OF THE PREFERRED EMBODIMENT

Figure 1:
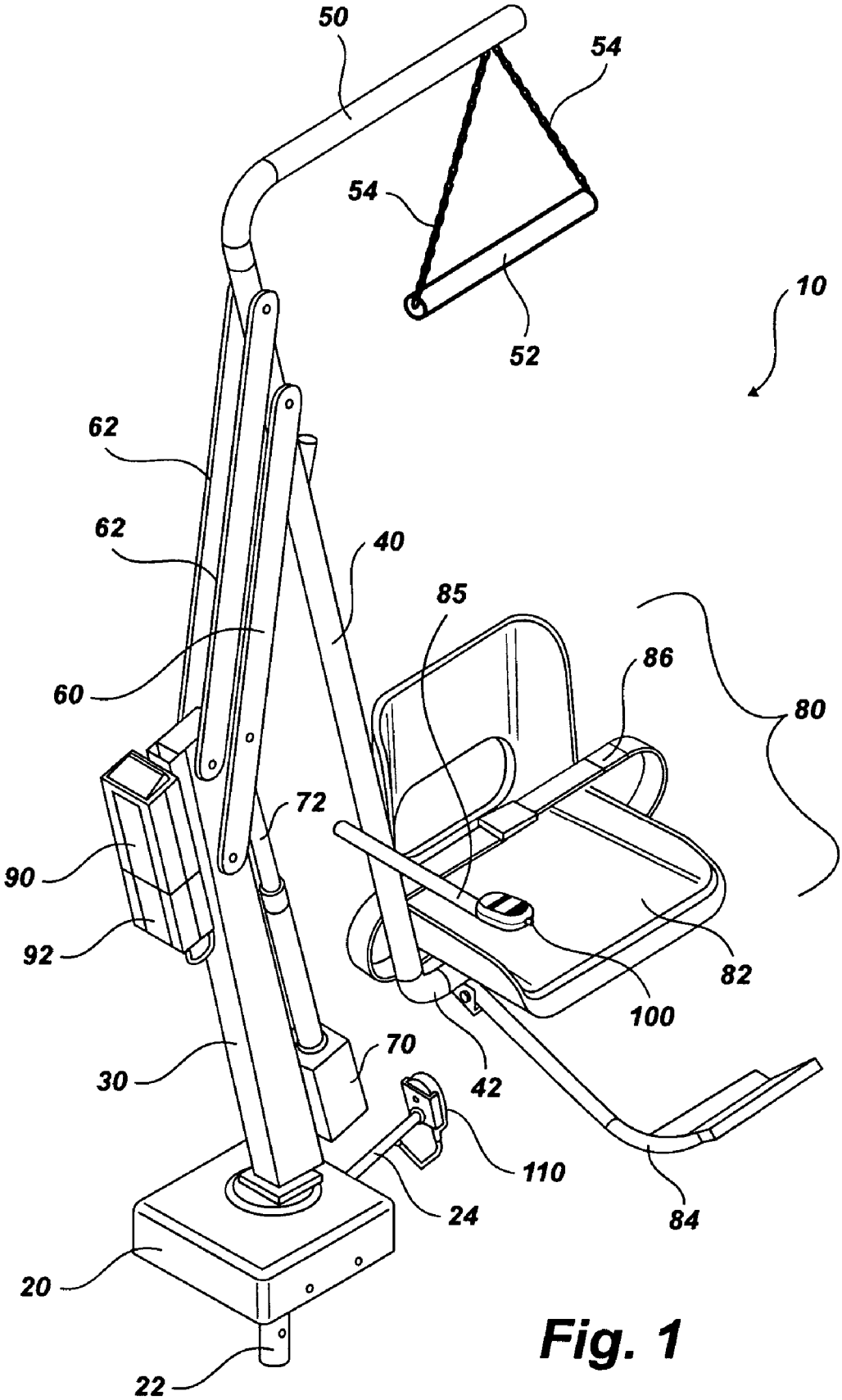
FIG. 1 shows a perspective view one exemplary embodiment of a lift in a raised position.

FIG. 1 shows a perspective view one exemplary embodiment of a lift 10 in a raised position. In the raised position, the lift 10 may be accessed by a user on the pool deck (not shown). The lift 10 is in a raised position, for example, when a user gets into or out of the lift 10 on the pool deck. The lift 10 includes a base 20 with a mast 30 pivotally connected thereto. The base 20 includes a stem 22 extending from the base 20. In the embodiment of FIG. 1, the lift 10 is a semi-stationary lift that can be removeably positioned in a pool deck by positioning the stem 22 in a suitable anchor (not shown) built into the pool deck, such as those anchors manufactured by Spectrum Products, LLC of Missoula, Mont. In other embodiments, the lift 10 may be stationary in that it may be permanently connected to a pool deck, or may be portable in that it does not attach to the pool deck even in a detachable manner.

First and second arms 60, 62 are pivotally connected at first ends to the mast 30. In the embodiment of FIG. 1, each of the arms 60, 62 is formed from a pair of rigid metal bars connected to opposing sides of the mast 30. A first actuator 70 moves the arms 60, 62 relative to the mast 30. In the embodiment of FIG. 1, the first actuator 70 is connected between the first arm 60 and the mast 30, and includes a motor (not shown) that extends and retracts a cylinder 72 to cause the arm 60 to pivot relative to the mast 30, to thereby raise or lower the lift 10. In the embodiment shown in FIG. 1, the mast 30 also rotates relative to the base 20, for example, to position a user over the pool or over the deck. Movement of the mast 30 about the base 20 is caused by a second actuator (not shown), such as a motor. A power supply 90, such as a battery, provides power to the first 70 and second actuators and is connected to the mast 30 near the upper end.

A seat support 40 is connected to second ends of the first and second arms 60, 62. As the arms 60, 62 move up and down, the seat support 40 likewise moves up and down. The seat support 40 in one embodiment is a hollow, elongated, rigid metal tube. A chair assembly 80 attaches to a lower portion (not shown) of the seat support 40. An upper portion 50 of the seat support 40 is a rigid bar positioned above a person seated in the lift 10. In the embodiment of FIG. 1, the upper portion 50 of the seat support 40 may be grasped by a user of the lift 10 to facilitate access into and out of the lift 10. In the exemplary embodiment of FIG. 1, an overhead bar 52 is suspended from the upper portion by chains 54 that adjust in length to accommodate users of different heights. Other means may be used to connect the overhead bar 52 to the upper portion 50 of the seat support 40, such as rope, cable, rigid bars with preset, adjustable stops, etc. In one embodiment (not shown), the upper portion 50 is a rigid elongated member that detachably connects to the seat support 40 to allow the overhead bar to be selectively used by the user. In another embodiment (not shown), the upper portion 50 detachably connects to the seat support 40 at a plurality of different positions along the seat support 40 such that the upper portion 50 may be used alone, without any additional overhead bar (e.g., 52 in FIG. 1) supported therefrom, and may be adjusted along the length of the seat support 40 to accommodate users of different heights.

A seat assembly 80 connects to the lower portion 42 of the seat support 40. In the exemplary embodiment of FIG. 1, the seat assembly 80 includes a seat 82, a seatbelt 86, a footrest 84 connected to the lower portion 42 of the seat support 40, and a control holder 85. The control holder 85 holds a first corded remote control 100 used by a user seated in the lift 10 to raise or lower the lift 10 and to rotate the mast 30 about the base 20 to position the seat assembly 80 over the pool deck or over the pool. In the embodiment of FIG. 1, the seat assembly 80 further includes an adjustable footrest 84. In one embodiment, the footrest 84 is self-adjusting, in that it pivotally connects to the lower portion (42 in FIG. 2) of the seat support 40 and is permitted to move upward. The footrest 84 moves upward upon contact with a hard surface, such as a pool deck or the bottom of a shallow spa or pool. In one embodiment, the footrest 84 floats in water and pivots upward to meet the user's feet in the water.

The embodiment of FIG. 1 includes a second remote control 110 connected to the base 20 of the lift 10 by a holder 24. Both the first and second remote controls 100, 110 control all functions of the lift 10 in this embodiment. The second remote control 110 allows an assistant on the pool deck or in the water near the lift 10 to control the lift 10 without having to be seated in the seat 82. For example, if the user is in the pool, the user or an assistant can move the lift 10 out of the water and over the pool deck without having to be near the first remote control 100. The remote controls 100, 110 are preferably water-resistant in one embodiment.

In one embodiment, a third control 92 is attached to the mast 30 proximate the power supply 90. In this position, the third control 92 is positioned at approximately waist height of a person, such as the user of the lift 10 or an assistant to the user, standing on the pool deck. The third controller may be permanently affixed to the mast 30 or may be a remote control that is removable from the mast 30 and attached to the lift 10 by a cord, like the first and second remote controls 100, 110 shown in FIG. 1. In other embodiments, one or more of the remote controls 100, 110, 92 may be wireless controls.

In use, a user raises the lift 10 to a raised position over the pool deck, and the user is positioned in the seat 82. Using the first remote control 100 attached to the seat assembly 80 (or another control, e.g., 92, 110), the user or an assistant rotates the seat assembly 80 over the pool. With the seat assembly 80 over the pool, the first control 100 (or another control) is used to lower the seat assembly 80 into the pool. Once in the pool, the user may exit the seat assembly 80. Using the second remote control 110 (or another control) the user or an assistant can raise the lift 10 back to a raised position and rotate the seat assembly 80 away from the pool, if desired. To exit the pool, the user or an assistant again uses a control 100, 110, 92 to position the seat assembly 80 over the pool and to lower the lift 10 into a lowered position. With the lift 10 in the lowered position, the user can access the seat 82 and then the lift 10 can be raised to a raised position and rotated away from the pool to allow the user to exit the seat 82 onto the pool deck.

Figure 2:
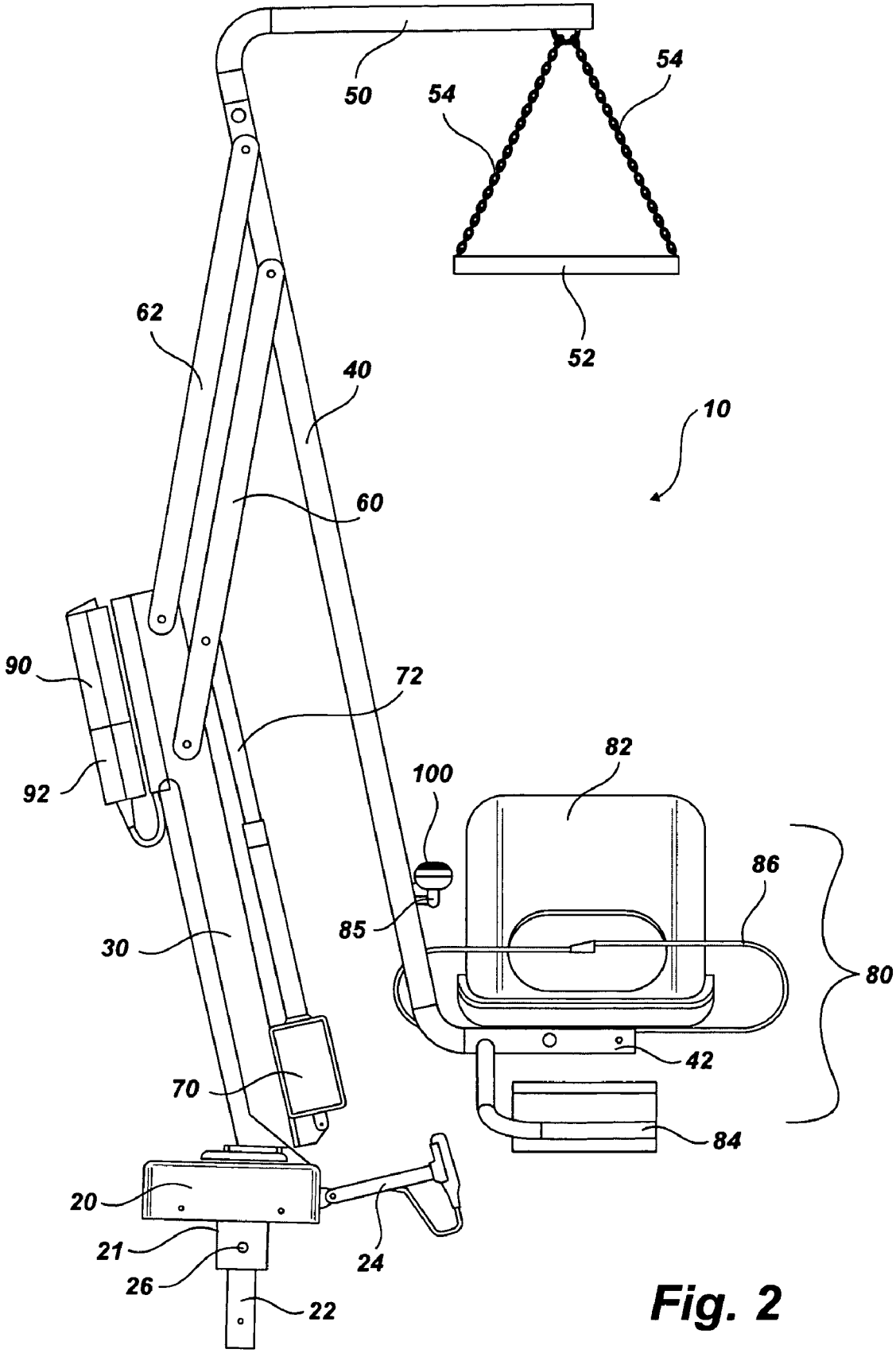
FIG. 2 shows an elevation view of the embodiment of the lift shown in FIG. 1, in a raised position.

FIG. 2 shows an elevation view of the embodiment of the lift 10 shown in FIG. 1, in a raised position. As shown in FIG. 2, the lower portion 42 of the seat support 40 passes below the seat assembly 80. Also shown in FIG. 2, the stem 22 includes an upper portion 21 that is positioned above the pool deck (not shown) in use. A pin 26 extends outward from the stem 22 and is used to lift and transport the lift 10. In one embodiment, a second pin (not shown in FIG. 2) is positioned on the opposing side of the pin 26, and both pins 26 are engaged by a lifting system (e.g., 300 in FIG. 10) to lift and move the lift 10.

Figure 3:
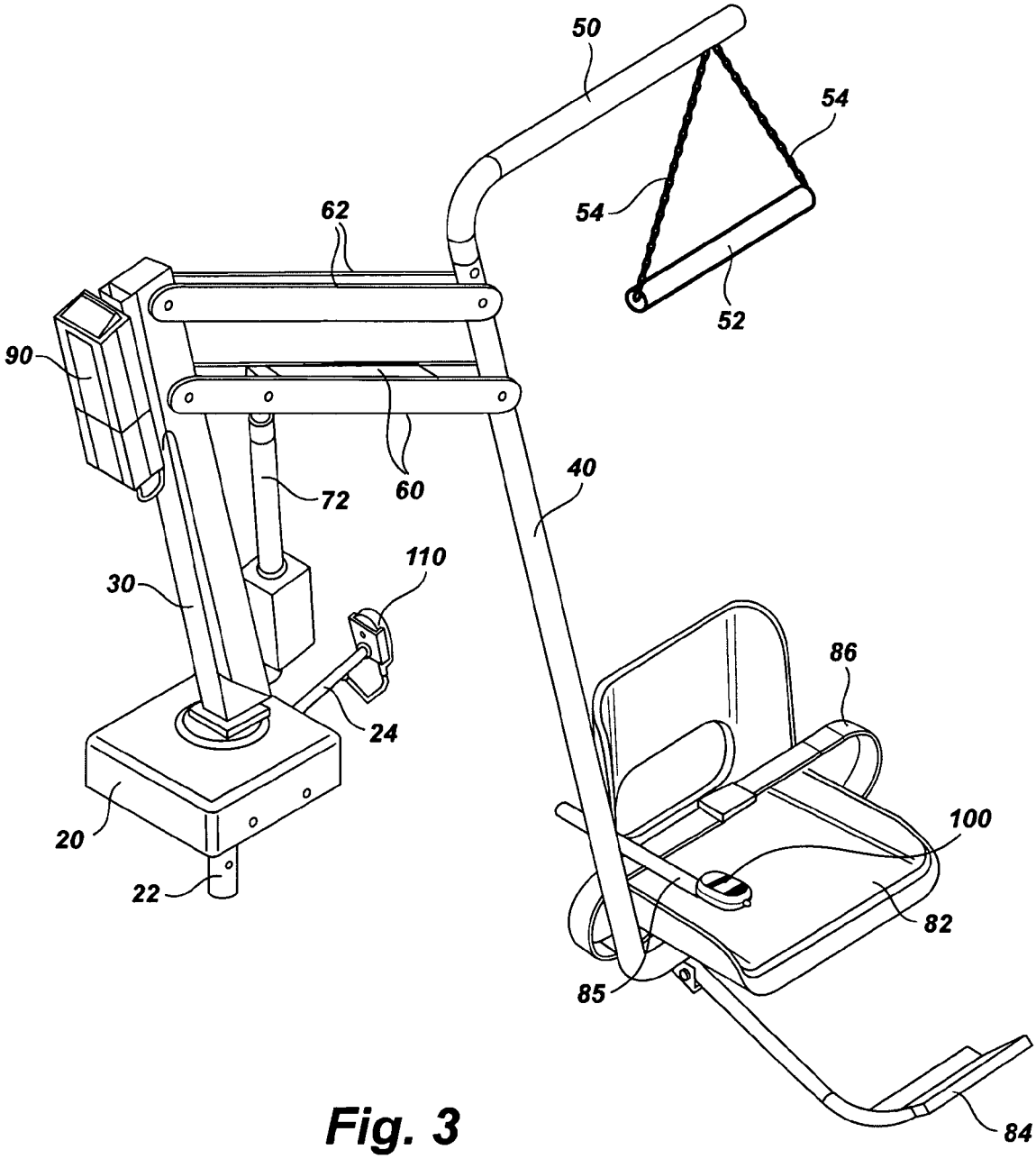
FIG. 3 shows a perspective view of the lift in a lowered position.

FIG. 3 shows a perspective view of the lift 10 in a lowered position. The arms 60, 62 extend somewhat downward from the mast 30 in this embodiment of the lift 10, in the lowered position.

Figure 4:
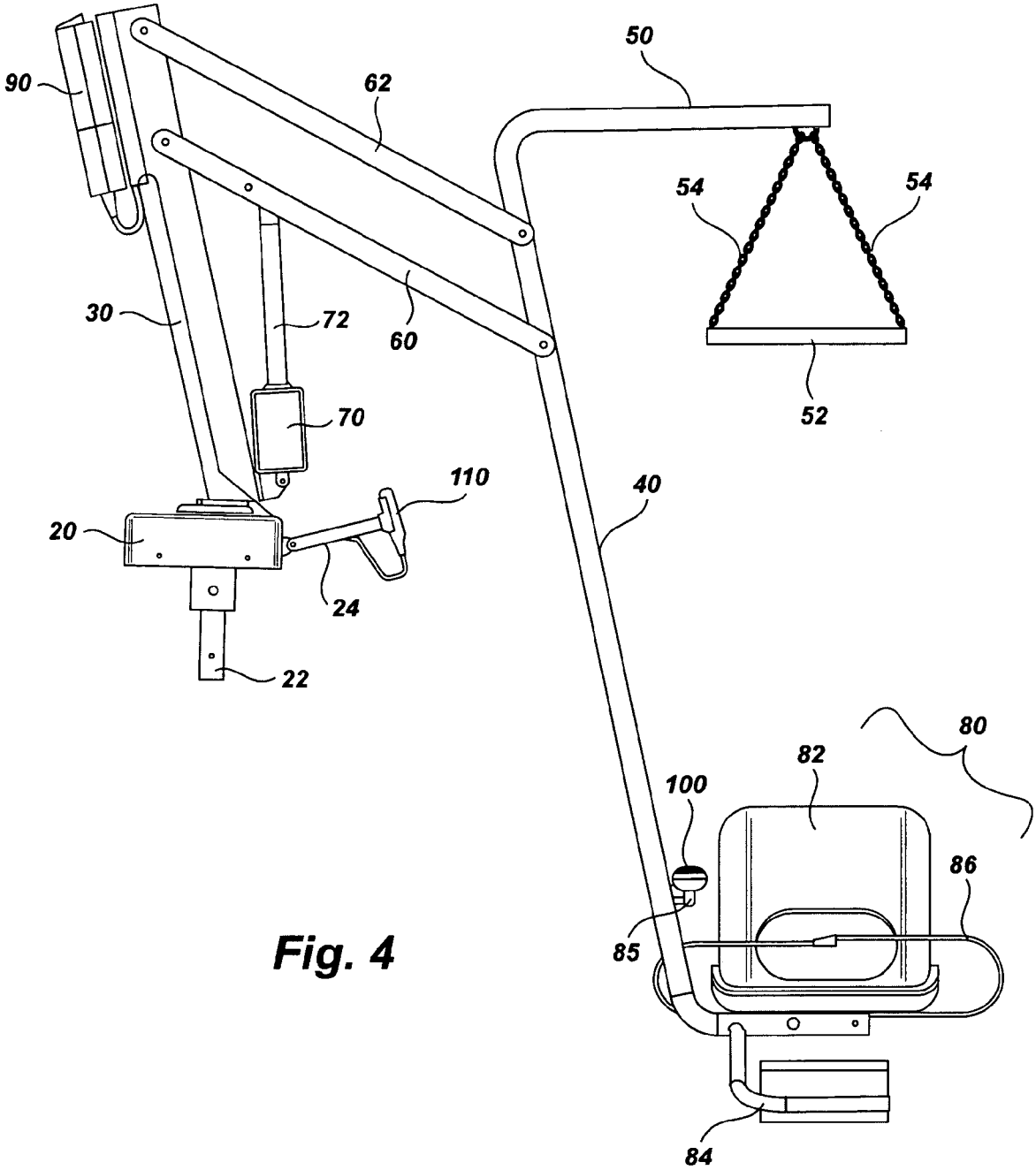
FIG. 4 shows an elevation view of the lift shown in FIG. 3, in the lowered position.

FIG. 4 shows an elevation view of the lift 10 shown in FIG. 3, in the lowered position. In use, the stem 22 mounts in an anchor (not shown) positioned in the pool deck. In one embodiment, the stem 22 is an elongated, cylindrical stem having a diameter in the range of 1.3-3.0 inches, and is adapted to be received in a conventional deck anchor. The deck anchor may be a multipurpose anchor, for example, that may also be used to hold starting platforms, ladders, chairs, or other types of pool accessories, and may have an outside diameter of 1.5 or 1.9 inches in one particular embodiment. In the lowered position, the seat assembly 80 is below the base 20 and below the pool deck (not shown) so that the user can exit the lift 10 into the pool.

Figure 5:
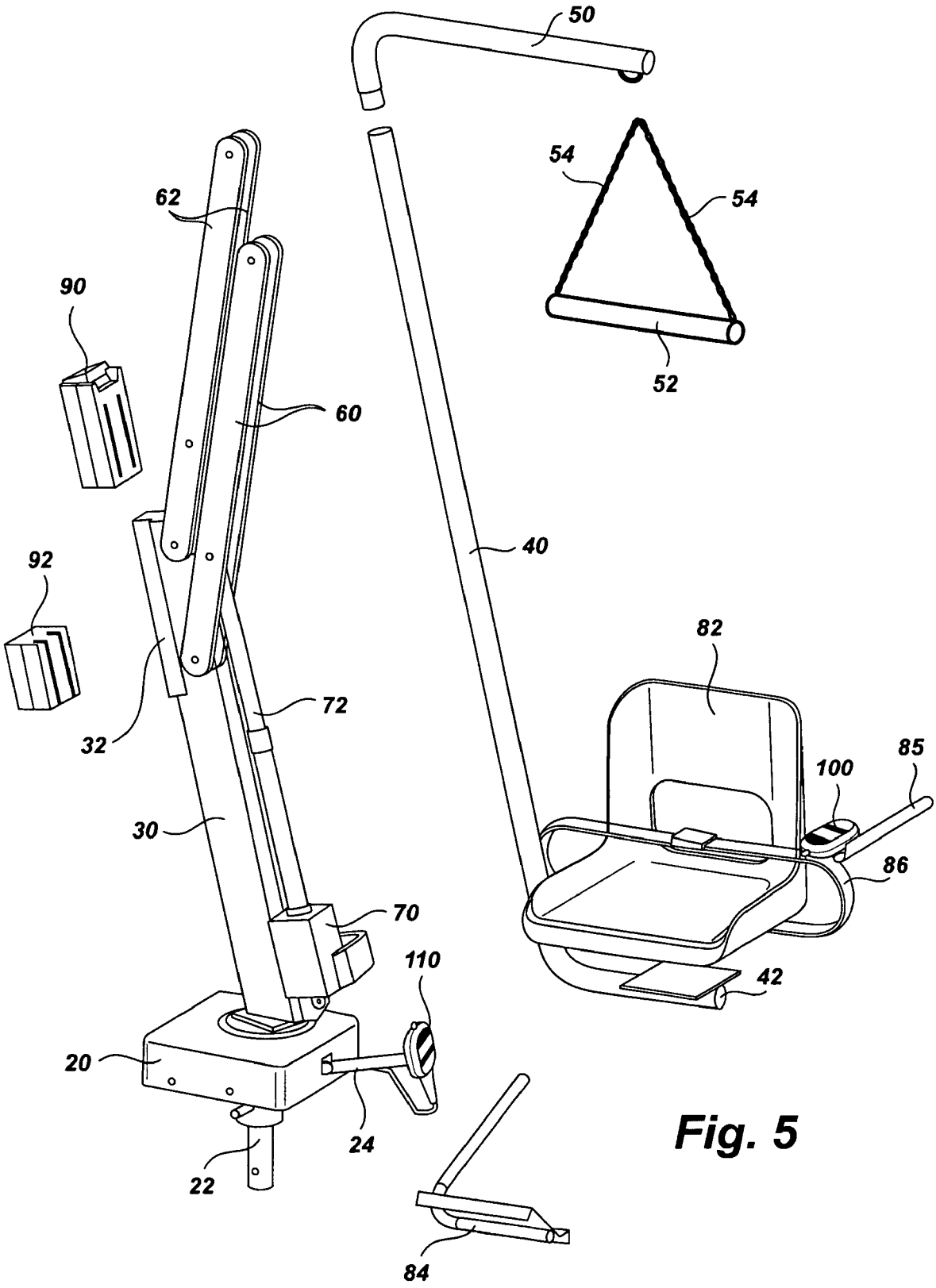
FIG. 5 shows an assembly view of the embodiment of the lift shown in FIGS. 1-4.

FIG. 5 shows an assembly view of the embodiment of the lift 10 shown in FIGS. 1-4. In one embodiment, the lift 10 is held together by multiple conventional fasteners, such as the unnumbered bolts, pins, screws, nuts, washers, etc. shown in FIG. 5. A bracket 32 holds the power supply 90 and the control 92 to the mast 30.

Figure 6:
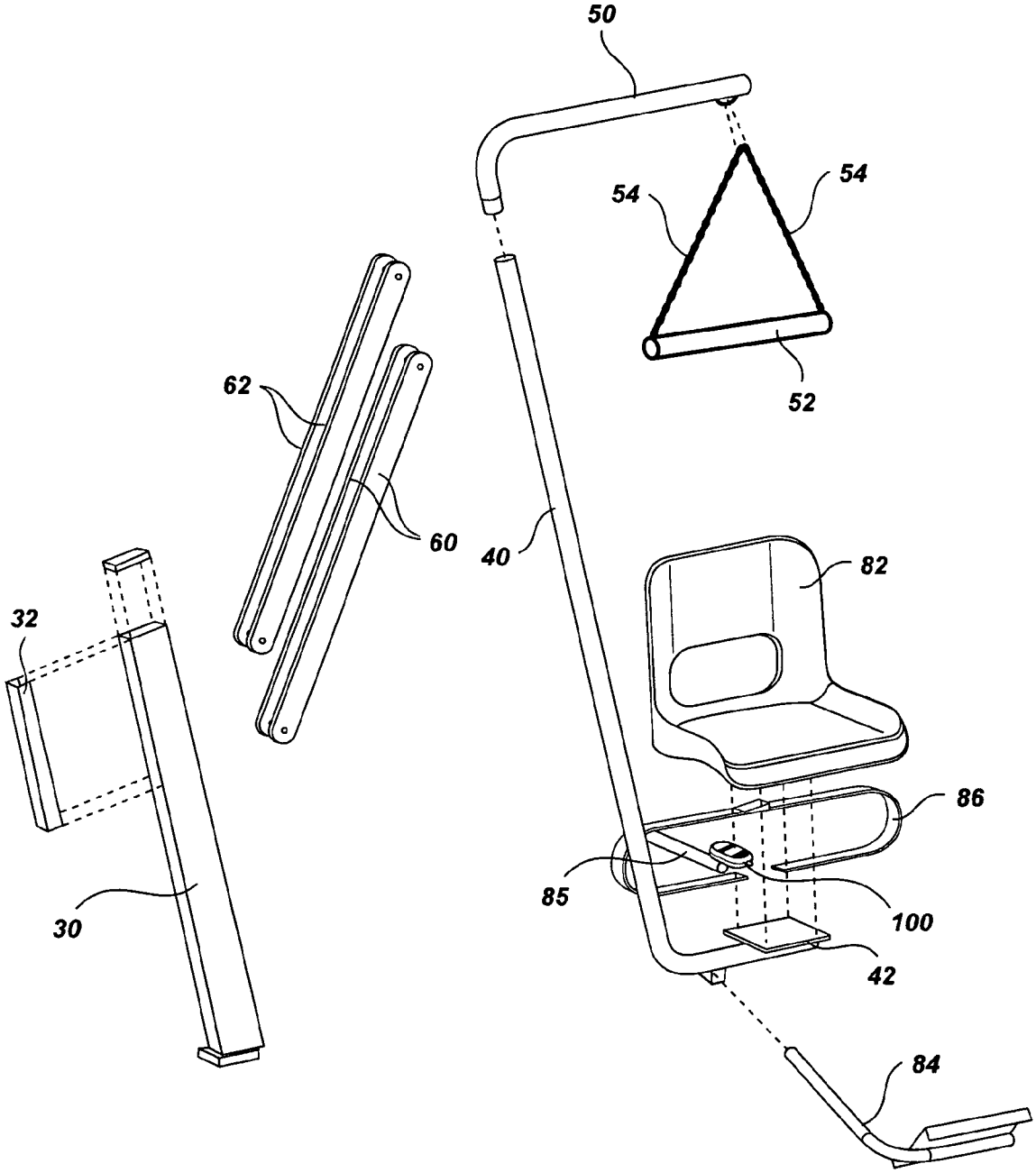
FIG. 6 shows another assembly view of the embodiment of the lift shown in FIG. 5.

FIG. 6 shows another assembly view of the embodiment of the lift 10 shown in FIG. 5.

Figure 7:
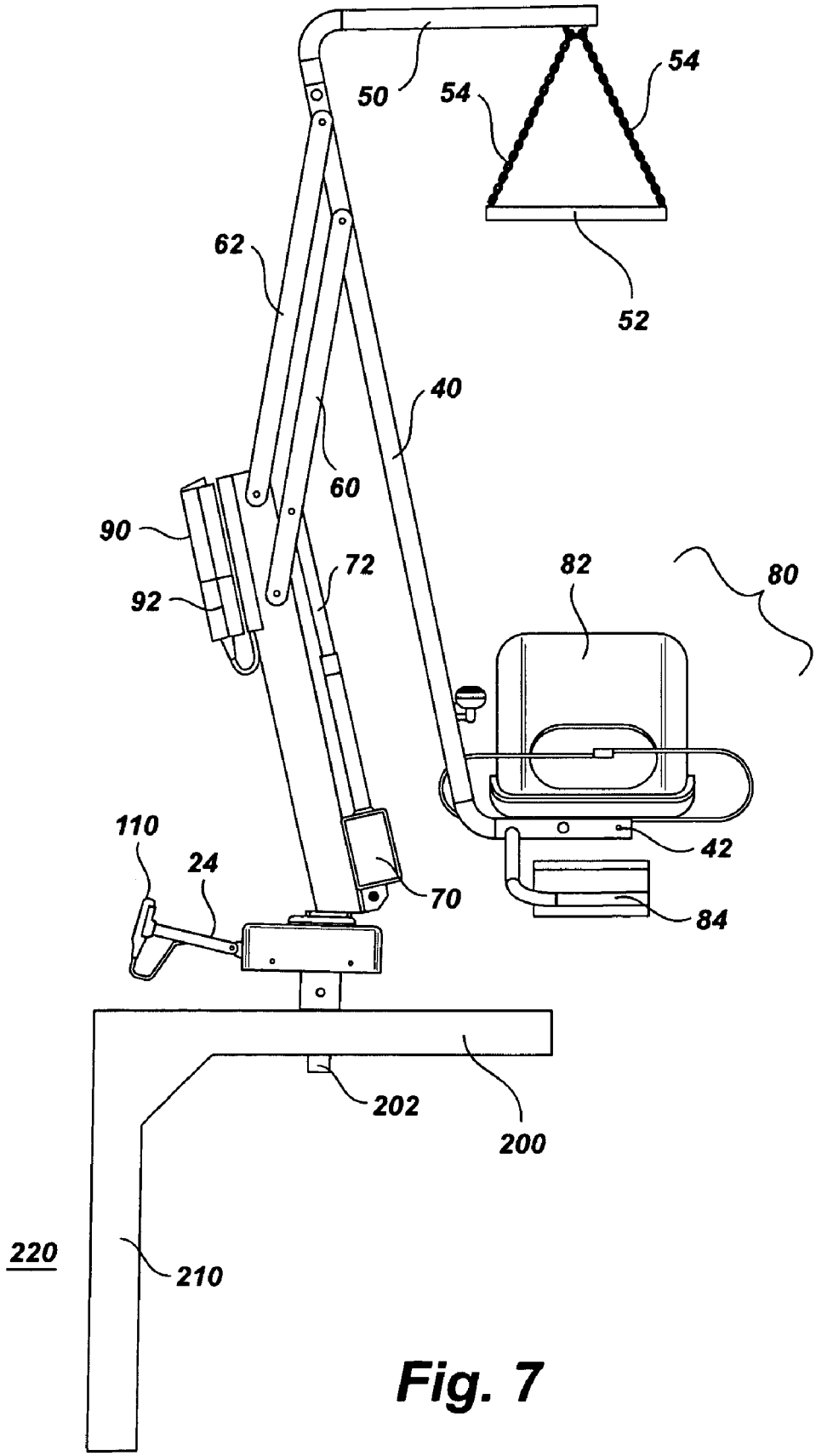
FIG. 7 shows an elevation view of the embodiment of the lift shown in FIGS. 1-6 mounted in a pool deck.

FIG. 7 shows an elevation view of the embodiment of the lift 10 shown in FIGS. 1-6 mounted in a pool deck 200. The lift 10 is shown in a raised position in FIG. 7, with the seat assembly 80 positioned over the deck 200. The pool 220 is shown to the left of the pool wall 210 that meets the deck 200 in the example of FIG. 7. The stem (22 in FIG. 1) of the lift 10 is received in an anchor 202 positioned in the deck 200.

Figure 8:
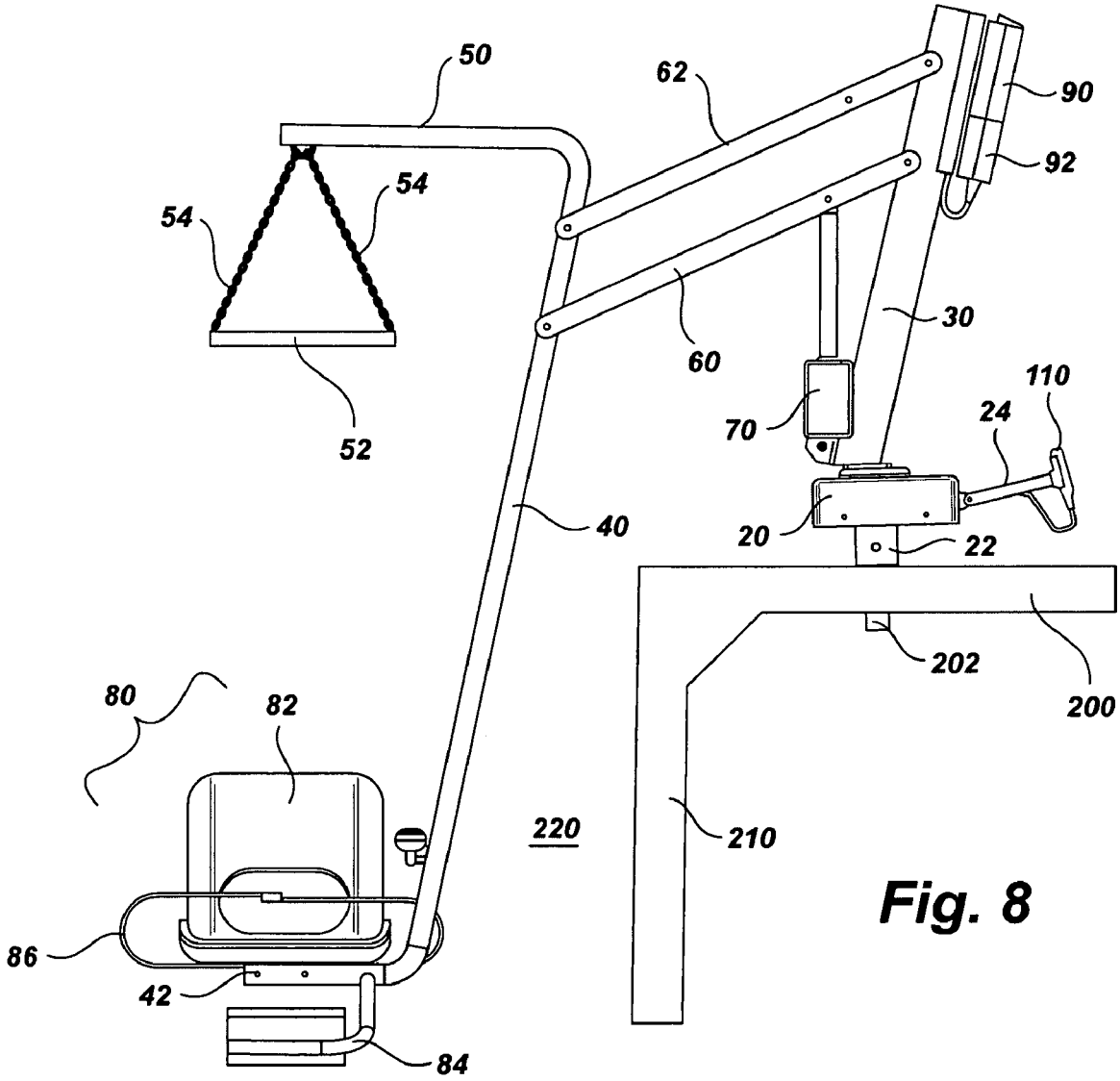
FIG. 8 shows an elevation view of the embodiment of the lift shown in FIG. 7, in a lowered position in which the seat assembly is positioned over and lowered into the pool.

FIG. 8 shows an elevation view of the embodiment of the lift 10 shown in FIG. 7, in a lowered position in which the seat assembly 80 is positioned over and lowered into the pool 220.

Figure 9:
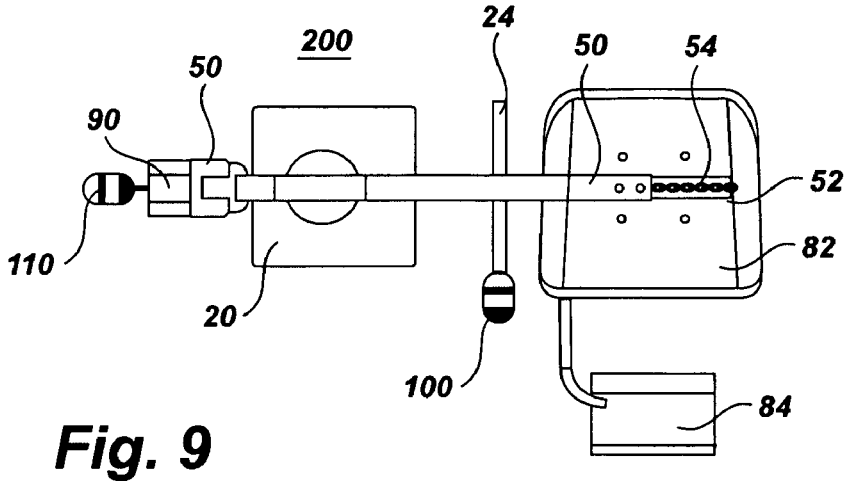
FIG. 9 shows a top view of the embodiment of the lift shown in FIG. 7.

FIG. 9 shows a top view of the embodiment of the lift 10 shown in FIG. 7.

Figure 10:
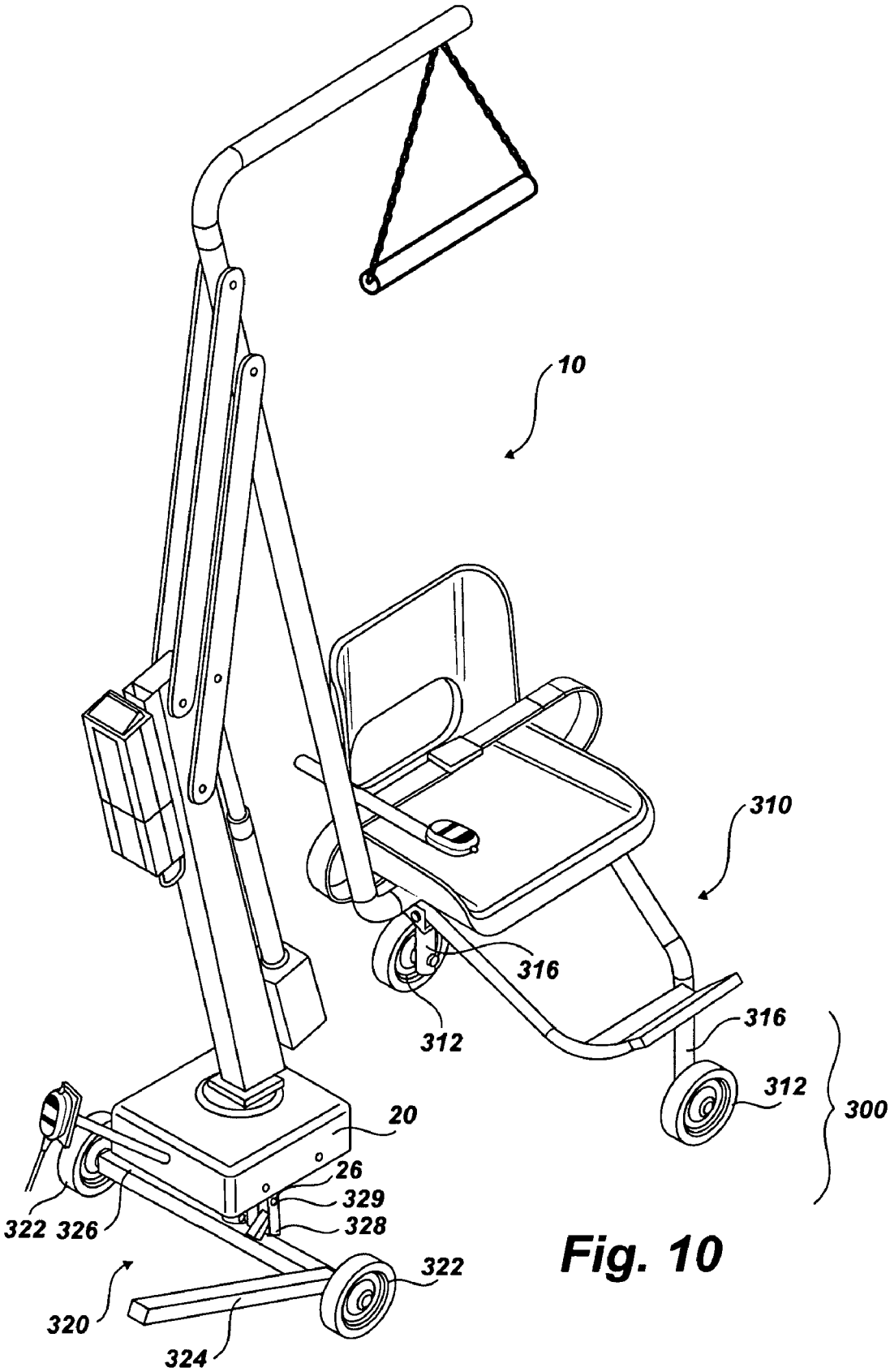
FIG. 10 shows a two-part transfer system for transporting the lift.

FIG. 10 shows a two-part transfer system 300 for transporting the lift 10. The system 300 includes a seat cart 310 includes wheels 312 and attaches to the lower portion 42 of the seat support 40. The base cart 320 includes wheels 322 and attaches to the base 20 of the lift 10. The base cart 320 includes a handle 324 to move the lift 10 about the wheels 312, 322 of the transfer system 300. The base cart 320 includes a rigid axel 326 that connects between the wheels 322 and one or more rigid members 328 extending outward from the axel 326. The rigid members include recessed portions 329 that receive pins 26 of the base 20 of the lift 10. The axel 326 further defines a stem-receiving portion (not shown) that wraps around the stem 22 of the lift 10.

In use, the base cart 320 is positioned proximate the base 20 of the lift 10 with the lift 10 still positioned in the anchor (e.g., 202 in FIG. 7) of the deck. The recessed portions 329 are aligned with the pins 26 and the handle 324 is in a generally vertical or upright position. The recessed portions 329 engage the pins 202, and the handle 324 is lowered to thereby raise the base 20 of the lift 10 out of the anchor 20. The axel 326 contacts the stem 22 at the stem receiving portion (327 in FIG. 11). In this position, the handle 324 may then be used to wheel the lift 10 around the pool deck.

Figure 11:
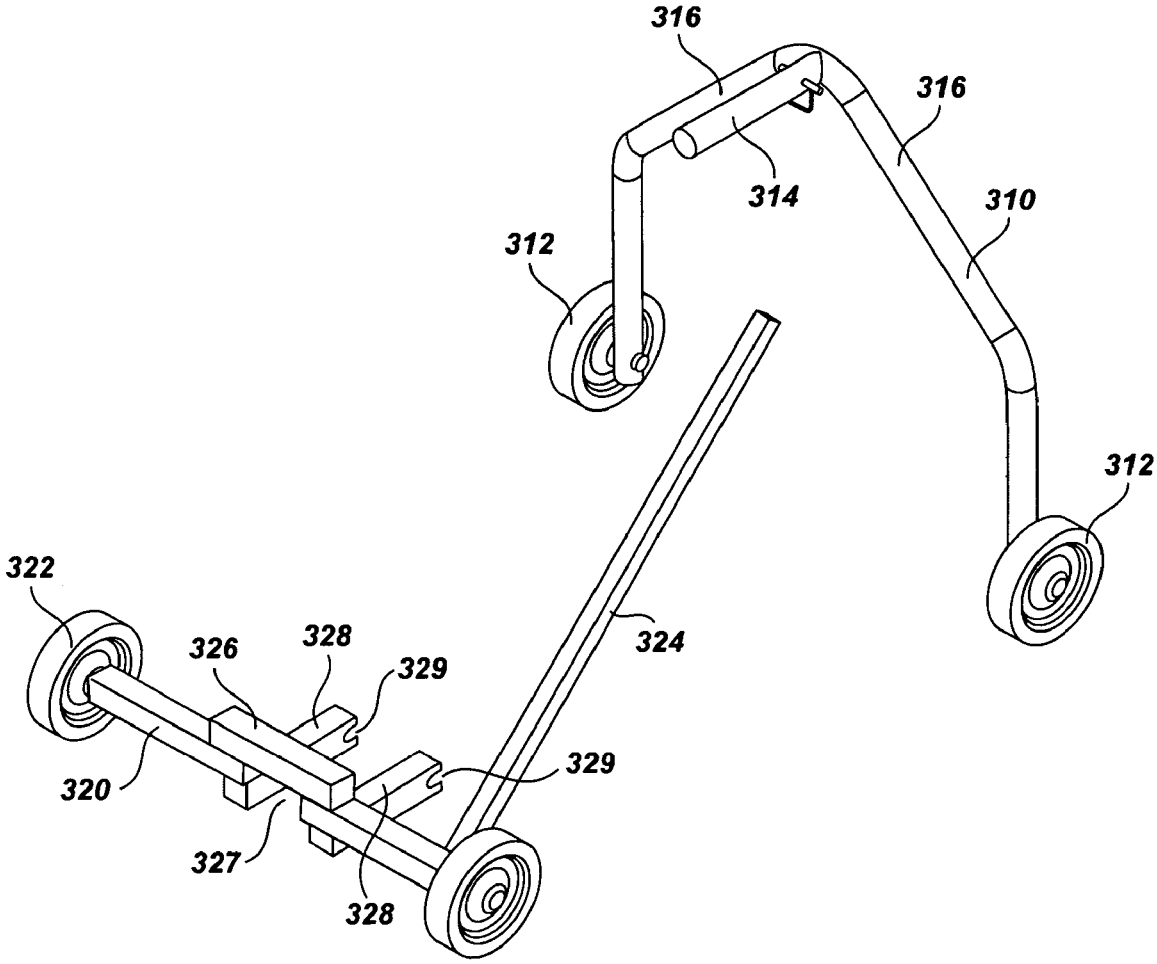
FIG. 11 shows a more detailed view of the embodiment of the transfer system shown in FIG. 10, without the lift present.

FIG. 11 shows a more detailed view of the embodiment of the transfer system 300 shown in FIG. 10, without the lift 10 present. In the embodiment of FIG. 11, the base cart 320 is in the disengaged position, as the handle 324 is generally upright and the rigid portions 328 are generally parallel to a ground surface. In this position, the recessed portions 329 are positioned to receive pins (26 in FIG. 10) of the lift 10 positioned on either side of the stem 22 of the base 20. The stem-receiving portion 327 of the axel 326 allows the axel 326 to be positioned generally underneath the base 20, around the stem 22. The seat cart 310 includes first and second rigid members 316 rising from the wheels that connect to a stem 314 at an apex. The stem 314 may be received in the lower portion 42 of the seat support 40 during use.

While the invention has been particularly shown and described with reference to a preferred embodiment thereof, it will be understood by those skilled in the art that various other changes in the form and details may be made without departing from the spirit and scope of the invention.

What is claimed is:

1. A lift comprising:

a base comprising an elongated stem that connects to an anchor positioned in a pool deck; and first and second pins positioned on opposing sides of the stem, wherein the pins may be engaged to lift and transport the lift;

a mast extending from the base;

an arm pivotally connected to the mast;

a seat assembly connected to the arm;

a footrest that self-adjusts to a user positioned in the seat assembly;

an overhead support positioned above the seat assembly;

a first actuator that moves the arm about the pivotal connection between the arm and the mast, thereby moving the seat assembly between a raised position and a lowered position; and a second actuator that rotates the seat assembly relative to the base.

2. The lift of claim 1, further comprising a seat support that connects the seat assembly to the ann, wherein the seat support is pivotally connected to the arm, and wherein the seat assembly is connected to a first end of the seat support, and wherein the overhead support is connected to a second end of the seat support.

3. The lift of claim 2, wherein the overhead support comprises an overhead bar suspended from the second end of the seat support.

4. The lift of claim 2, wherein the overhead support comprises a rigid elongated bar that adjustably connects to the second end of the seat support at a plurality of different positions, wherein the adjustable bar is positioned at different distances from the seat assembly in the different positions.

5. The lift of claim 1, wherein the footrest is pivotally connected to the seat support and pivots upward in response to contact with a surface.

6. The lift of claim 5, wherein the footrest is buoyant and pivots upward in response to being submerged in water.

7. The lift of claim 1, wherein the first actuator comprises a piston connected to the arm, wherein movement of the piston causes the arm to move relative to the mast, thereby moving the lift between the raised and lowered positions.

8. The lift of claim 7, wherein the first actuator further comprises a motor that moves the piston.

9. The lift of claim 8, further comprising a control that controls the first actuator.

10. The lift of claim 9, wherein the control is a remote control accessible to a user positioned in the seat assembly.

11. The lift of claim 8, further comprising:

a first control that controls the first actuator, wherein the first control is positioned proximate the seat assembly and is accessible to a user positioned in the seat assembly, and a second control that controls the first actuator, wherein the second control is positioned proximate the base of the lift.

12. The lift of claim 11, wherein at least one of the first and second controls is a remote control that is operable by a user positioned away from the lift.

13. The lift of claim 11, wherein the second control is a remote control accessible by a user positioned in a pool adjacent the lift.

14. The lift of claim 11, wherein the seat assembly further comprises an arm rest, and wherein the first control connects to the arm rest.

15. The lift of claim 11, fUrther comprising a third control that controls the first actuator, wherein the third control is connected to the mast and is accessible to a person on a deck on which the lift is positioned.

16. The lift of claim 15, wherein the first, second, and third controls control movement of the second actuator.

17. The lift of claim 16, wherein the first actuator moves the Lift between the raised and lowered positions to thereby move the seat assembly between the deck and a pool adjacent the deck, and wherein the second actuator rotates the seat assembly about the base, between a first position wherein the seat assembly is positioned over the deck, and a second position wherein the seat assembly is positioned over the pool.

18. The lift of claim 1, wherein the stem is a cylindrical anchor having a diameter in the range of 1.3-3.0 inches, and is adapted to be received in a multipurpose deck anchor.

19. The lift of claim 1, wherein the seat assembly comprises a seat that faces a direction substantially normal to a plane formed by the mast and the arm.

20. A Lift comprising:

a seat support having first and second ends;

a seat attached to the seat support proximate the first end;

a footrest that self adjusts to a user positioned in the seat, wherein the footrest is buoyant and moves upward in response to being submerged in water;

an overhead support attached to the seat support proximate the second end; and an actuator that moves the seat relative to a pool deck on which the lift is positioned.

21. The lift of claim 20, wherein the overhead support comprises a rigid, elongated portion that forms the second end of the seat support, and an overhead bar attached to the rigid, elongated portion by a connector depending from the rigid, elongated portion.

22. The lift of claim 20, wherein the overhead support comprises a rigid, elongated member that detachably connects to the second end of the seat support.

23. The lift of claim 20, further comprising a base that connects to the pool deck.

24. The lift of claim of claim 23, wherein the base comprises an elongated stem that connects to an anchor positioned in the pool deck.

25. A lift comprising:

a seat support having first and second ends;

a seat attached to the seat support proximate the first end;

an overhead support attached to the seat support proximate the second end;

an actuator that moves the seat relative to a pool deck on which the lift is positioned; and a base comprising an elongated stem that connects to an anchor positioned in the pool deck; and first and second pins positioned on opposing sides of the stem, wherein the pins may be engaged to lift and transport the lift.

26. The lift of claim 25, wherein the overhead support comprises a rigid, elongated portion that forms the second end of the seat support, and an overhead bar attached to the rigid, elongated portion by a connector depending from the rigid, elongated portion.

27. The lift of claim 25, wherein the overhead support comprises a rigid, elongated member that detachably connects to the second end of the seat support.

28. The lift of claim 25, further comprising a footrest that self-adjusts to a user positioned in the seat.

29. A lift comprising:

a base comprising a stem that connects to an anchor of a deck and first and second pins positioned on opposing sides of the stem and extending generally outward from the stem, wherein the pins may be accessed to lift and transport the lift;

a mast extending from the base;

an arm pivotally connected to the mast;

a seat assembly connected to the arm;

an overhead support positioned above the seat assembly;

a first actuator that moves the arm about the pivotal connection between the arm and the mast, thereby moving the seat assembly between a raised position and a lowered position; and a second actuator that rotates the seat assembly relative to the base.

30. The lift of claim 29, further comprising a seat support that connects the seat assembly to the arm, wherein the seat support is pivotally connected to the arm, and wherein the seat assembly is connected to a first end of the seat support, and wherein the overhead support is connected to a second end of the seat support.

31. The lift of claim 30, wherein the overhead support comprises a rigid elongated bar that adjustably connects to the second end of the seat support at a plurality of different positions, wherein the adjustable bar is positioned at different distances from the seat assembly in the different positions.

32. The lift of claim 30, wherein the overhead support comprises an overhead bar suspended from the second end of the seat support.

33. The lift of claim 32, wherein the overhead bar is adjustably connected to the second end of the seat support such that the overhead bar may be positioned at a plurality of different distances from the second end of the seat support.

34. The lift of claim 29, wherein the seat assembly comprises a seat that faces a direction substantially normal to a plane formed by the mast and the arm.

35. The lift of claim 29, wherein the first actuator comprises a piston connected to the arm, wherein movement of the piston causes the arm to move relative to the mast, thereby moving the lift between the raised and lowered positions.

36. The lift of claim 35, wherein the first actuator further comprises a motor that moves the piston.

37. The lift of claim 36, further comprising a control that controls the first actuator.

38. The lift of claim 37, wherein the control is a remote control accessible to a user positioned in the seat assembly.

39. The lift of claim 36, further comprising:

a first control that controls the first actuator, wherein the first control is positioned proximate the seat assembly and is accessible to a user positioned in the seat assembly, and a second control that controls the first actuator, wherein the second control is positioned proximate the base of the lift.

40. The lift of claim 39, wherein the seat assembly further comprises an arm rest, and wherein the first control connects to the arm rest.

41. The lift of claim 39, wherein at least one of the first and second controls is a remote control that is operable by a user positioned away from the lift.

42. The lift of claim 39, further comprising a third control that controls the first actuator, wherein the third control is connected to the mast and is accessible to a person on a deck on which the lift is positioned.

43. The lift of claim 42, wherein the first, second, and third controls control movement of the second actuator.

44. The lift of claim 43, wherein the first actuator moves the lift between the raised and lowered positions to thereby move the seat assembly between the deck and a pool adjacent the deck, and wherein the second actuator rotates the seat assembly about the base, between a first position wherein the seat assembly is positioned over the deck, and a second position wherein the seat assembly is positioned over the pool.

45. The lift of claim 39, wherein the second control is a remote control accessible by a user positioned in a pooi adjacent the lift.

46. The lift of claim 29, wherein the seat assembly further comprises a footrest that self-adjusts to a user positioned in the seat assembly, and wherein the footrest is pivotally connected to the seat support and pivots upward in response to contact with a surface.

47. The lift of claim 46, wherein the footrest is buoyant and pivots upward in response to being submerged in water.

48. A lift comprising:

a seat support having first and second ends;

a seat attached to the seat support proximate the first end;

a footrest that self-adjusts to a user positioned in the seat, wherein the footrest is buoyant and self-adiusts by moving upward when submerged in water; and an actuator that moves the seat relative to a pool deck on which the lift is positioned.

* * * * *